US010940499B2

(12) United States Patent
Pletcher

(10) Patent No.: US 10,940,499 B2
(45) Date of Patent: Mar. 9, 2021

(54) TUBE SPRAY GUN

(71) Applicant: David S Pletcher, Piedmont, OK (US)

(72) Inventor: David S Pletcher, Piedmont, OK (US)

( * ) Notice: Subject to any disclaimer, the term of this patent is extended or adjusted under 35 U.S.C. 154(b) by 714 days.

(21) Appl. No.: 15/216,773

(22) Filed: Jul. 22, 2016

(65) Prior Publication Data

US 2018/0021798 A1 Jan. 25, 2018

(51) Int. Cl.

| | |
|---|---|
| ***B05B 13/02*** | (2006.01) |
| ***B05B 15/62*** | (2018.01) |
| ***B05B 13/04*** | (2006.01) |
| ***B05B 7/02*** | (2006.01) |
| ***B05B 1/12*** | (2006.01) |

(52) U.S. Cl.

CPC ..... *B05B 13/0214* (2013.01); *B05B 1/12* (2013.01); *B05B 7/02* (2013.01); *B05B 13/0436* (2013.01); *B05B 15/62* (2018.02)

(58) Field of Classification Search

CPC ..... B05B 13/0421; B05B 13/0207; B05B 13/0214; B05B 13/1436; B05B 15/62; B05B 1/12; B05B 7/02

USPC ..... 239/120, 103, 532, 538; 118/307, 118/DIG. 11

See application file for complete search history.

(56) References Cited

U.S. PATENT DOCUMENTS 2,535,451 A * 12/1950 Phillips ..... B05B 13/0436 118/305
2,593,295 A * 4/1952 Granfield ..... F23D 91/02 239/532
2,851,005 A * 9/1958 Pledger ..... B05B 13/0214 118/307
3,334,639 A * 8/1967 Grant ..... E21B 41/02 134/122 R
3,994,443 A * 11/1976 Shenker ..... B05B 1/205 239/545
4,007,705 A * 2/1977 Sherer ..... B05B 13/0436 118/710
4,076,175 A * 2/1978 Bert ..... B05B 13/0214 239/532
4,595,607 A * 6/1986 Betteridge ..... B05C 9/14 118/307
4,709,717 A * 12/1987 Rannigan ..... B05C 17/0245 134/199
4,995,749 A * 2/1991 Gornik ..... B05C 17/0245 134/199
5,205,306 A * 4/1993 Peterson ..... A47K 3/287 134/104.2
5,207,833 A * 5/1993 Hart ..... B05B 13/0436 118/307

(Continued)

*Primary Examiner* — Joseph A Greenlund
(74) *Attorney, Agent, or Firm* — Edward L. White

(57) ABSTRACT

An Tube Spray Gun for coating an elongated member comprising a handle, a flow trigger, at least one positioner engaging the member and adapted to maintain a spray tip in a desired position relative to the member, a mounting means for releasably engaging the spray tip assembly around the member, a coating supply fluidly connected to the spray tip and a flow activated by the trigger and a spray tip assembly calibrated to provide complete radial coverage of the member, whereby an user engages the positioner placing the apparatus around the member and activates the flow trigger while moving the apparatus along the member to coat the entire radial surface of the member with a single pass.

19 Claims, 7 Drawing Sheets

(56) References Cited

U.S. PATENT DOCUMENTS

| | | | | |
|---|---|---|---|---|
| 5,292,074 | A * | 3/1994 | Clark | B05B 13/0278 239/546 |
| 6,592,055 | B1 * | 7/2003 | Marino | B05B 15/625 239/275 |
| 6,881,266 | B1 * | 4/2005 | Daykin | B05B 13/0436 118/305 |
| 8,800,575 | B2 * | 8/2014 | Angel | E21B 17/085 134/199 |
| 9,061,299 | B1 * | 6/2015 | Fodor | B05B 13/0207 |
| 2002/0011259 | A1 * | 1/2002 | Pociask | B08B 3/026 134/34 |
| 2017/0304866 | A1 * | 10/2017 | Hwang | B05C 1/022 |
| 2018/0021798 | A1 * | 1/2018 | Pletcher | B05B 15/62 239/120 |

* cited by examiner

TUBE SPRAY GUN

CROSS-REFERENCE TO RELATED APPLICATIONS

None.

FIELD OF THE INVENTION

The invention generally relates to coating the entire surface of an elongated member such as a pipe in a single pass. In particular, the invention relates to an apparatus for coating a pipe in a single pass while providing 360° surface coverage, wherein the apparatus is easily positioned at one end of the pipe and moved along the pipe with apparatus spraying and covering the entire surface with a coating until the user comes to the end of the pipe where they remove the apparatus from the pipe, and position the apparatus on the next pipe to be coated.

BACKGROUND

The current methods of coating a pipe for example in a tubular fence whether it be cylindrical, square or some other shape are manpower intensive, costly, and inefficient. A tubular fence may comprise multiple fence sections wherein each fence section may typically consist of two vertical tubular posts with multiple horizontal tubular cross-members are fixedly attached to the vertical posts. The number of cross-members varies depending on the purpose of the fence but number is commonly three to five. One of the cross-members would generally be near the ground making it difficult to coat the underside of the cross-member. One method currently employed is to coat one side of the fence through its entire section length with a coating device such as a brush, roller, or the like, then switch to the other side and continue coating until the entire tubular member is coated. If the tubing is square the method is further complicated with the additions of a defined top and bottom and having to position the coating device to cover these surfaces. Coating using this method is time consuming and inefficient.

Another method, available to coat the fence, utilizes a standard spray gun and the user walks along and near to the cross-member while spraying. This method has one of the disadvantages as the previous method, thus requiring the person to move to the other side of the fence to complete the coating. There are several disadvantages to this method that were not in the previous method including overspray and waste of material. In compensating for the overspray by reducing the fan of the spray nozzle, the unintended consequence is the addition of too much material onto the cross-member causing runs and dripping onto lower cross-members and second, the user is limited to coating in limited or no wind conditions. In states such as Oklahoma, limited or no wind conditions are few and far between.

Either of the methods described above have significant disadvantages that are manpower intensive, costly and wasteful and ultimately inefficient.

SUMMARY OF THE INVENTION

The present invention overcomes these shortcomings by providing an apparatus that allows a user to coat the tubular surface of a single member in a single pass with full 360 coverage under multiple wind conditions. The apparatus may consist of a spray gun, an extension, a spray tip assembly wherein the individual spray nozzles are adjustable and/or a spray nozzle group is adjustable and an adjustable wind shield.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
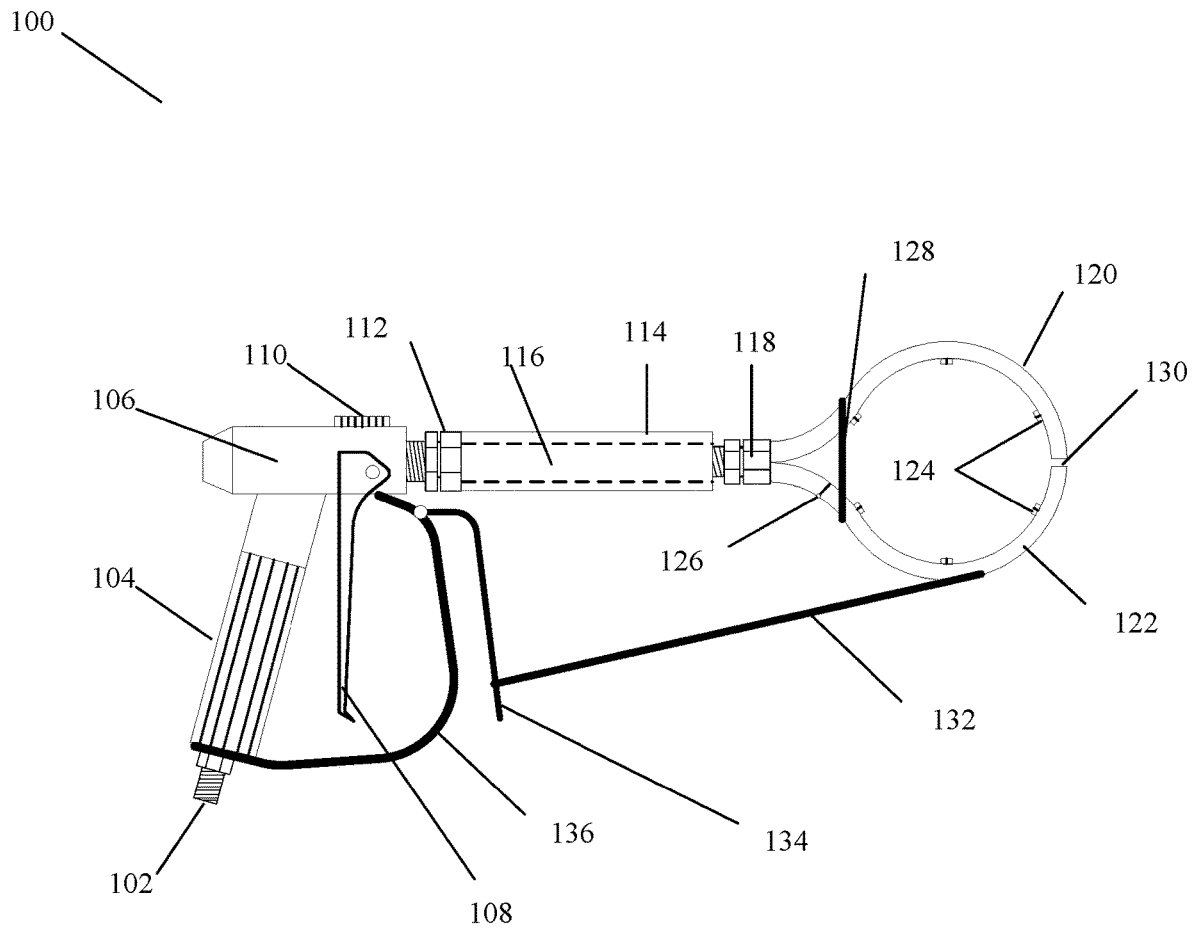
FIG. 1 is a view of a tube spray gun with automatic closing spray tip.

FIG. 1 is a view of one embodiment of the tube spray gun with an automatic closing spray tip 100. The automatic tube spray gun 100 may comprise a coating supply 102, a handle 104, a valve assembly 106, a flow trigger 108, an extension 114, a spray tip swivel 118, and upper spray tip assembly 120, a lower spray tip assembly 122, spray assembly opener 134, and a spray tip assembly opener linkage 132. In a preferred embodiment, a spray assembly opener 134 may be hingedly affixed to the flow trigger guard 136, which protects the flow trigger 108 from accidental activation and discharge, to provide a pulling action on the hingedly attached lower spray tip assembly 122. The hinged attachment point on trigger guard 136 is a preferred location of the spray assembly opener 134, however other positions on the automatic tube spray gun 100 are suitable for the hinging function. The spray assembly opener 134 may be mechanically connected to the lower spray tip assembly 122 or could use an electronic means such as servos to actuate the lower spray tip assembly 122 with opening and closing. In the preferred embodiment, a wire may be used to connect spray assembly opener 134 and the lower spray tip assembly 122.

The lower spray tip assembly 122 is hingedly attached to the automatic tube spray gun 100 via a hinge 126. This hinge 126 allows the lower spray tip assembly 122 to be opened and closed during positioning and operation of the automatic tube spray gun 100.

A user actuates the spray assembly opener 134 which in turn opens the lower spray tip assembly 122 creating an opening 130 for placement around the tubular member to be coated. Once the spray tip assemblies 120, 122 are positioned around the tubular member to be coated, the user releases the spray assembly opener 134 wherein the retention device 128 closes the lower spray tip assembly 122 by moving the lower spray tip assembly 122 into its normal closed operating position. The lower spray tip assembly 122 remains in the closed position by a retention device 128 until a user reactivates the spray assembly opener 134. The retention device 128 may be selected from a spring, an elastic member such as a rubber band, a hydraulic and pneumatic device wherein the retention device 128 in this preferred embodiment is a spring.

Once the tube spray gun 100 is positioned around the tubular member for coating, the user may then activate the flow trigger 108 allowing the coating to flow from a coating source through the coating supply connection 102 through the handle 104 that is fluidly connected to the valve assembly 106. The coating continues to flow through the handle swivel 112 through the extension 114 via a coating flow channel 116 continuing through a second spray tip swivel 118 onto the upper spray tip assembly 120 and the lower spray tip assembly 122 at which point the coating exits the automatic tube spray gun 100 through the adjustable spray tip assemblies 120, 122 and their spray nozzles 124. The flow of the coating into the spray tip assemblies 120, 122 is controlled by the volume control 110 on top of the valve assembly 106. In the current embodiment, there are three methods of adjusting the volume of the coating applied to the tubular member with the first method discussed previously and the other two methods to be discussed below in FIG. 6 and FIG. 8.

In the preferred embodiment, the spray tip swivel 118 allows the user to change the position of the spray tip assemblies 120, 122 for ease of use when coating a tubular member. The spray tip assemblies 120, 122 could be rotated 90 degrees using the spray tip swivel 118 that would allow it to coat vertical surfaces. Additionally, the spray tip assemblies 120, 122 could be positioned to some angle in between 0 and 90 degrees to a coat tubular members that were not horizontal or vertical. Additionally, the position of the spray tip assemblies 120, 122 may be fixed to a desired position using the spray tip swivel 118

Additionally, the handle swivel 112 allows the user another degree of flexibility as they are coating a surface. The user may rotate the handle 104 while holding the extension 114 thus allowing the user to avoid handle obstructions while coating the tubular member and without disturbing the position of the spray tip assemblies 120, 122.

Figure 2:
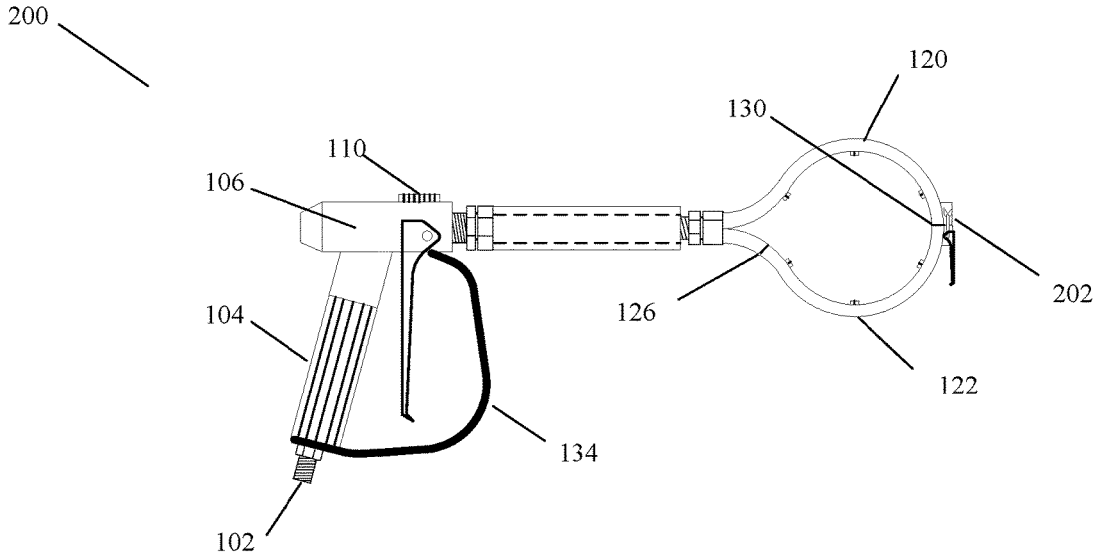
FIG. 2 is a view of a latchable tube spray gun with the spray tip assembly in the latched position.
Figure 3:
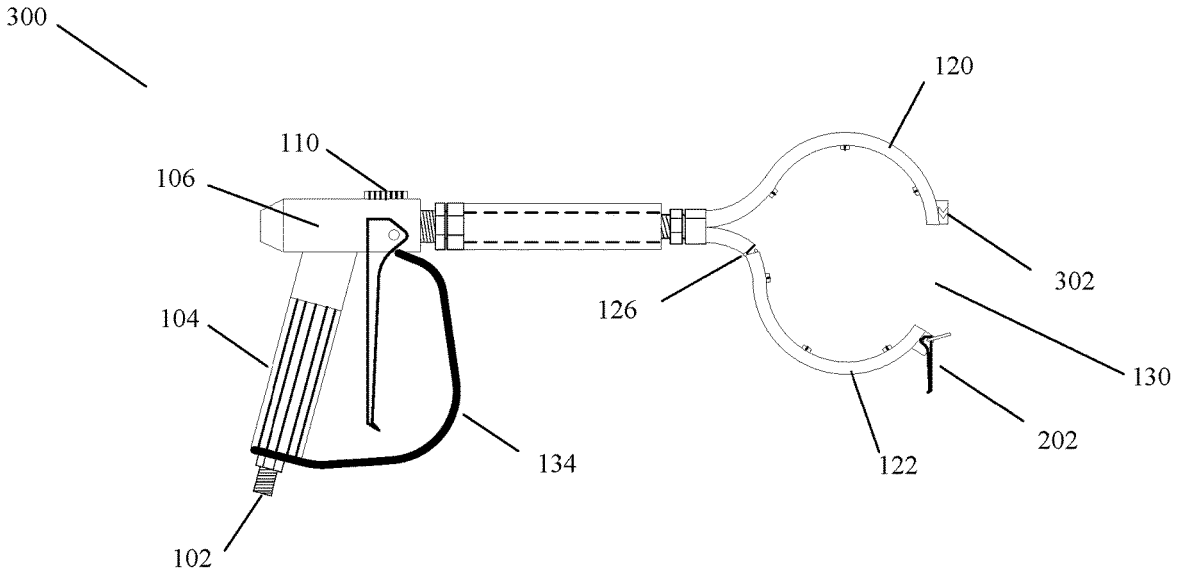
FIG. 3 is a view of the latchable tube spray gun with the spray tip assembly in the unlatched position.

FIG. 2 and FIG. 3 are views of one embodiment of a latchable tube spray gun in the latched position 200 and unlatched position 300. The latchable tube spray gun 200 may comprise a coating supply 102, a handle 104, a valve assembly 106, a flow trigger 108, an extension 114, a spray tip swivel 118, an upper spray tip assembly 120, a lower spray tip assembly 122 and a draw latch 300. The components of the latchable tube spray gun 200 may be similar to the automatic tube spray gun 100 with the differences residing in the spray tip assembly area and retention device 128.

The user opens up the draw latch 202 and removes the draw latch 202 from the draw latch strike plate 302. This allows the lower spray tip assembly 122 to swing open wherein the lower tip assembly 122 may be hingedly attached to the latchable tube spray gun 200 at the spray assembly hinge 126. By unlatching the draw latch 202, a spray tip assembly opening 130 is created between the upper spray tip assembly 120 and the lower spray tip assembly 122. The latchable tube spray gun 200 is positioned to surround the tubular member to be coated and then the user repositions lower spray tip assembly 122 and reconnects the draw latch 202 to the draw latch strike plate 302 on the upper spray-tip assembly 120 and locks it in place thereby preventing the lower spray tip assembly 122 from separating at the hinge 126 while in operation. This closed draw latch 202 allows the user to move the latchable tube spray gun 200 gun along tubular member coating the surface while maintaining the spray tip assemblies 120, 122 in the desired positions. After coating the tubular member, the user then may release the draw latch 202, allowing the latchable tube spray gun 200 to be removed from the tubular member. See FIG. 3 for the open-latched position.

Figure 4:
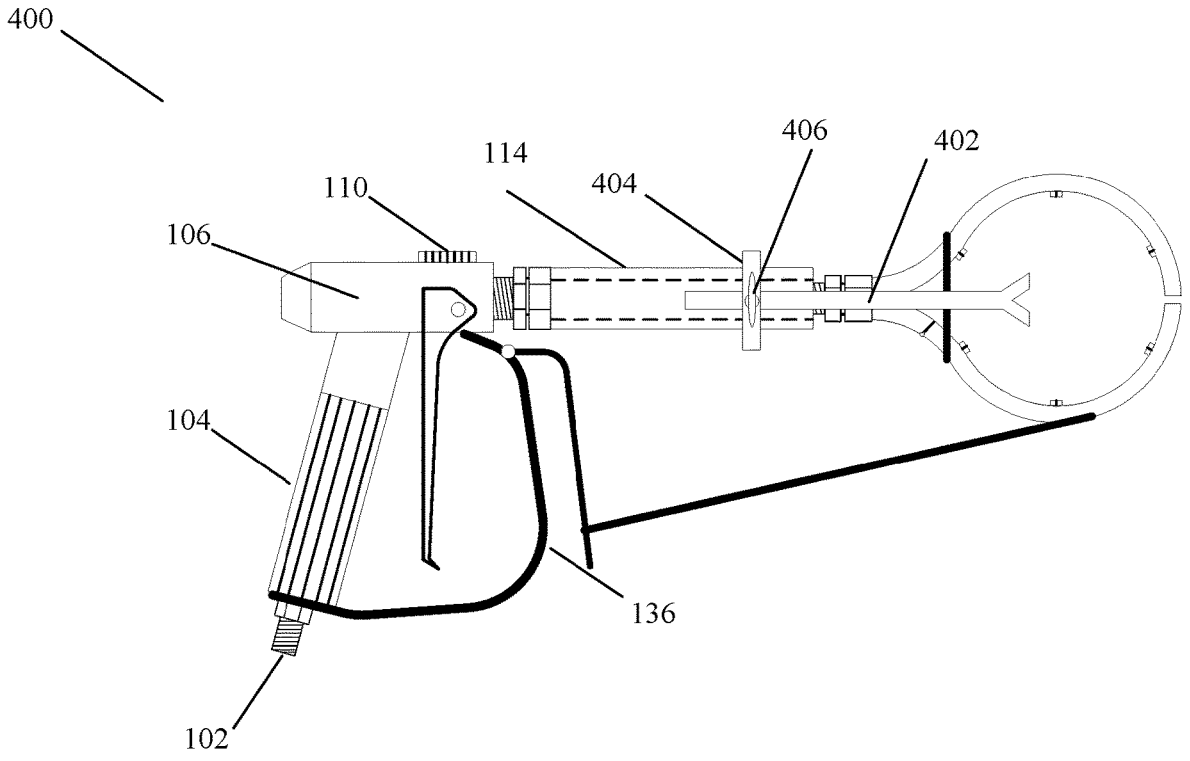
FIG. 4 is a view of one embodiment of the tube spray gun with a positioning device.

FIG. 4 is a view of one embodiment of the tube spray gun 100 with an attached positioning device 400. The tube spray gun with a positioner 400 may comprise either of the previous spray gun embodiments with an extension 114, a positioner 402, a positioner holder 404 and a positioner adjustment 406.

The user may release the retention mechanism described above in the previous embodiments creating a spray tip assembly 122 opening 130 for the tubular member to enter. The positioner 402 is placed in contact with the tubular member wherein the user applies slight pressure on the positioner 402 to provide contact with the tubular member's surface to be coated thereby maintaining the desired position of the spray tip assemblies 120, 122 while coating the tubular member. The retention device 128 is reengaged and the user activates the flow trigger 108 with the positioner 402 in place as they move the spray gun along the tubular member. Upon completing the coating, the user disengage the retention device 128 and removes the spray gun from the tubular member. Additionally, the positioner 402 may be placed on the uncoated side of the tubular member to prevent marring the coating.

The positioner 402 may slide through the positioner holder 404 to obtain the desire position of the positioner 402 on the tubular member to be coated. Once the desired position is obtained, a positioner adjustment 406 is engaged to secure the positioner 402 in place. The positioner adjustment 406 may be selected from a device as a thumbscrew or a device apparent to one skilled in the art that would maintain the positioner 402 in place.

In a preferred embodiment, the positioner 402 may be connected to the extension 114 through a position holder 404 that may be a collar that is fixedly attached to the extension 114. Additionally, this collar may be rotate as required as the spray tip assemblies 120, 122 are rotated. The V-groove in the positioner 402 may assist the user in maintaining the desired position on cylindrical and polygonal type surfaces.

Figure 5:
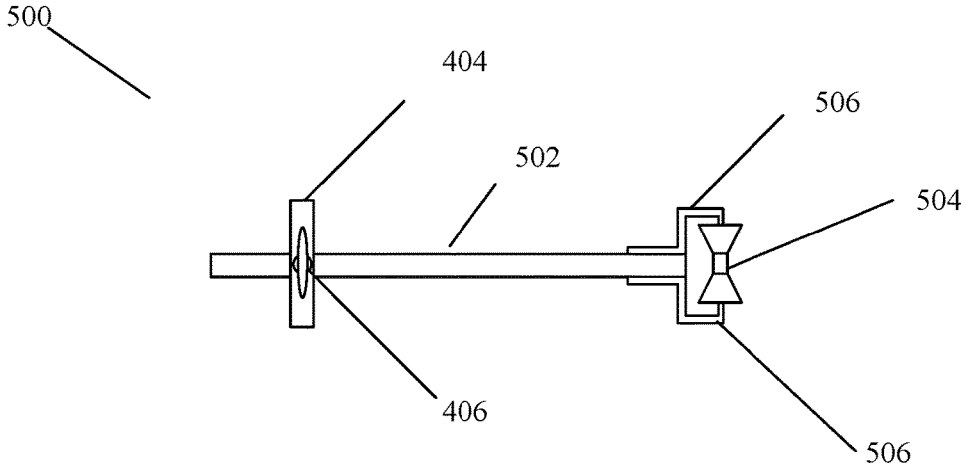
FIG. 5 is a view of a roller positioning device.

FIG. 5 is a view of alternate embodiment of the spray gun positioner 400. In this embodiment, the roller positioning device 500 may comprise of a positioner holder 404, a positioner adjustment 406, the adjustable extension 502, a roller 504 and a roller axles 506. This embodiment is similar to the previous positioner embodiment in that it uses the positioner holder 404, a positioner adjustment 406 that is fixedly attached to the spray gun extension 114 and allows the adjustable extension 502 to slide through the positioner holder 404 and be secured in place by the positioner adjustment 406. The roller axles 506 are fixedly attached to the adjustable extension 502 wherein roller 504 is rotationally attached to the axles 506. The roller 504 may rotate freely around the axles 506.

As described above, the lower spray tip assembly 122 is opened allowing the user to place the spray tip assemblies 120, 122 around the tubular member and place the roller 504 in contact with the tubular member. The user reengages the retention device 128 and maintains the roller 504 in contact with the tubular member.

The user moves the roller 504 along the tubular member while coating the tubular member's surface. The roller 504 is preferably placed in front of the spray tip assemblies 120, 122 to prevent marring of the newly coated surface. After coating the tubular member, the user disengage the spray gun as described above.

Figure 6:
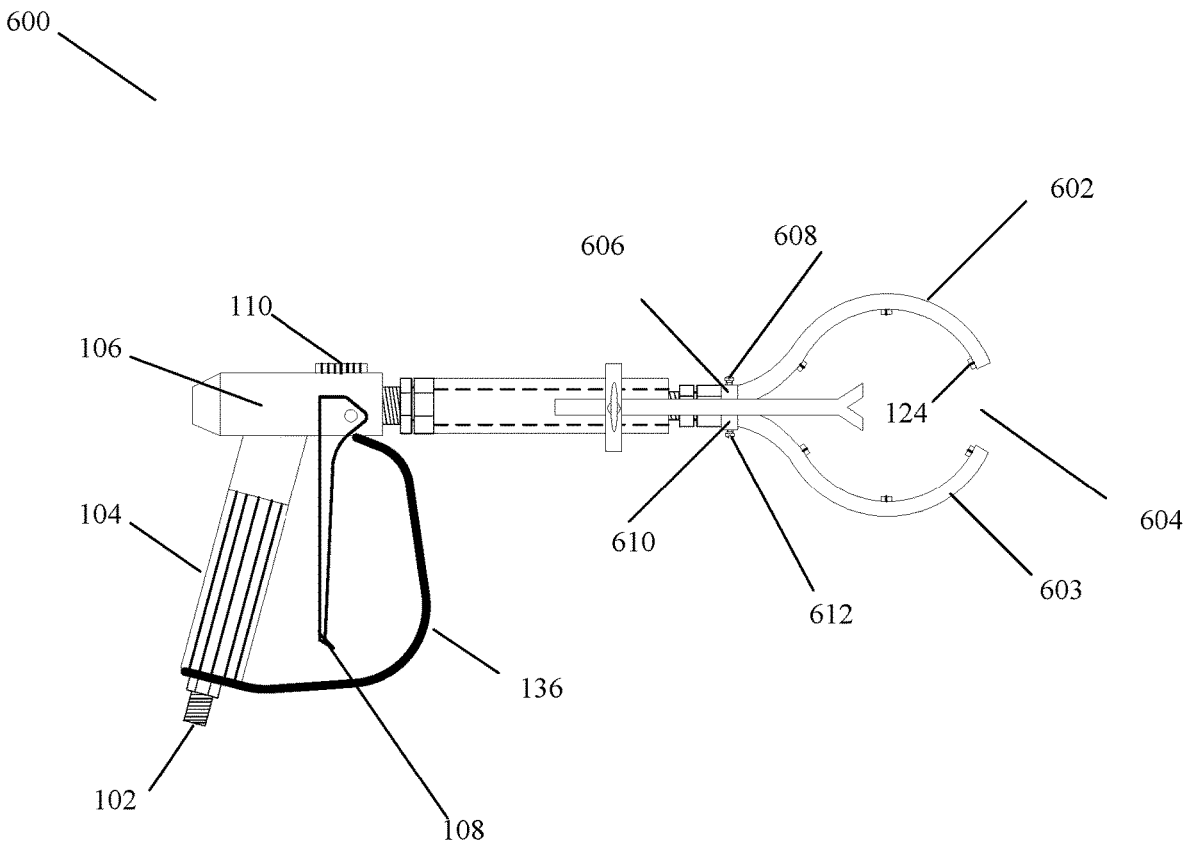
FIG. 6 is a view of a tube spray gun with a fixed spray assembly.

FIG. 6 is a view of tube spray gun with a fixed spray assembly 600. A fixed tube spray gun 600 may comprise a coating supply 102, a handle 104, a valve assembly 106, a flow trigger 108, an extension 114, a spray tip swivel 118, an upper fixed spray tip assembly 602 and a lower fixed spray tip assembly 603 that create a fixed opening 604. In this embodiment, the user places the spray tip assemblies 602, 603 over the desired tubular member to be coated and may engage one of the positioners described above to obtain the desired position of the spray tip assemblies 602, 603. The fixed opening 604 of the spray tip assemblies 602, 603 may limit the size of tubular member that may be coated.

The user inserts the tubular member through fixed opening 604 inside the fixed spray tip assemblies 602, 603. Then they actuate the flow trigger 108 allowing the coating to exit the adjustable spray nozzles 124 and move the spray gun 600 along the tubular member coating the surface. The user preferably maintains the fixed spray tip assembly 602, 603 such that the adjustable spray nozzles 124 are equidistant from the tubular member to provide a uniform surface coating or the user may employ the positioners described above to assist in maintaining the nozzles desired positioning.

Additionally, this embodiment illustrates an upper volume control 606 and a lower volume control 610. It would be apparent to one skilled in the art that these spray tip assemblies 602, 603 volume controls may also be utilized to control the coating volume in the spray tip assemblies of the different spray gun embodiments described above. The upper volume control 606 may be adjusted by the upper volume control adjustment 608 such as a screw that may be adjusted in or out to control the flow of coating to the upper spray tip assembly 602. The lower volume control 610 controls the flow into the lower tip assembly 603 and may be adjusted using the lower volume control adjustment screw 612. The lower volume control adjustment 612 may be adjusted to increase or restrict the flow of coating to the lower spray tip assembly 603. Both the upper volume control and the lower volume control allow the user to control the overall volume of coating going to a set of spray nozzles 124. It would apparent to one skilled in the art that other methods may be employed to control the flow volume to the spray tip assemblies 602, 603 and the use of an adjustment screw is but one method.

Figure 7:
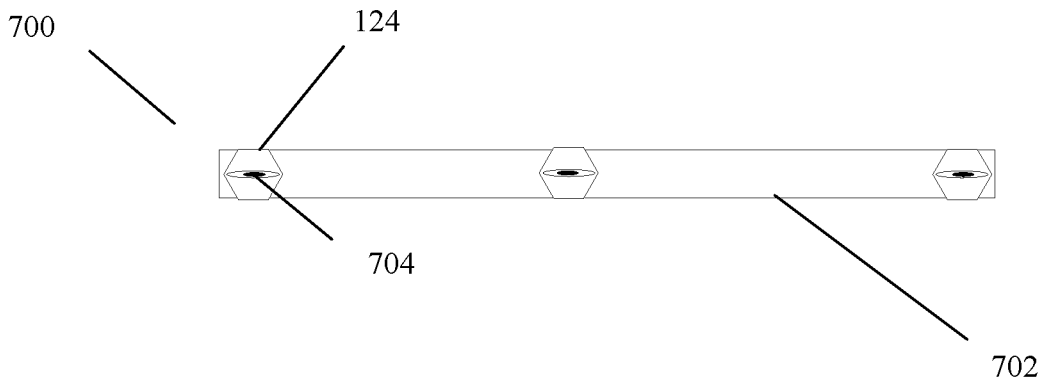
FIG. 7 is a view of a narrow pattern spray nozzle assembly.
Figure 8:
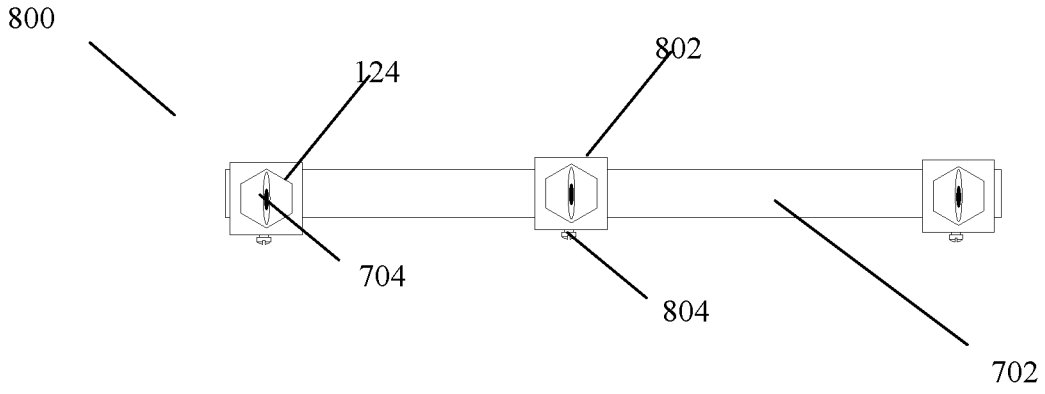
FIG. 8 is a view of a wide pattern spray nozzle assembly.

FIG. 7 and FIG. 8 are views of spray nozzle assemblies with a narrow pattern 700 and a wide pattern 800 for the various embodiments of the spray gun described above. The spray nozzle assembly with the narrow pattern 700 may comprise spray tubing 702, spray nozzles 124, and the nozzle orifices 704. The spray tubing 702 may be fluidly connect the spray gun providing the coating to the spray nozzles 124 wherein the coating exits the spray nozzles 124 through the nozzle orifices 704 and is imparted on the surface of the tubular member. The number of adjustable spray nozzles 124 in the assemblies may be determined by one skilled in the art based on the coverage desired, the size and shape of the tubular member, the type of coating being applied and the conditions where the coating will be applied. When the spray nozzle 124 is positioned such that the nozzle orifices 704 is parallel to the spray tubing 702 then the spray nozzle assembly 700 will provide a very narrow spray pattern. The narrow spray pattern is useful in high wind situations where the user may want to reduce the amount of coating that is lost while spraying and maximizing the amount of coating that's being imparted onto the surface while also limiting overspray.

The wide pattern spray nozzle assembly 800 may comprise spray tubing 702, spray nozzles 124, nozzle orifices 704, individual volume controls 802, and individual volume control adjustments 804. The wide pattern spray nozzle assembly 800 may have multiple spray nozzles 124 with the nozzle orifices 704 perpendicular to the tubing to provide the wide spray pattern. The spray nozzles 124 may be individually adjusted to positions in between parallel and perpendicular as desired by the user. The wide spray pattern nozzle assembly 800 is useful in coating a tubular member in no or low wind conditions. Additionally, the wide spray pattern nozzle assembly 800 may allow the user to more quickly coat a tubular member.

The spray nozzles 124 may be attached to individual volume controls 802 that may have individual volume control adjustments 804 on the side wherein each of the separate nozzles 124 may be adjusted to a desired flow rate. The individual volume controls 802 may be adjusted by the individual volume control adjustment 804 such as a screw that is adjusted in or out to control the flow of coating to the spray nozzles 124. This individual volume control is not unique to the wide pattern spray nozzle assembly 800 and may also be applicable to the narrow pattern spray tip assembly 700. It would apparent to one skilled in the art that other methods may be employed to control the flow volume through the spray nozzles 124 and the use of an adjustment screw is but one method.

Figure 9:
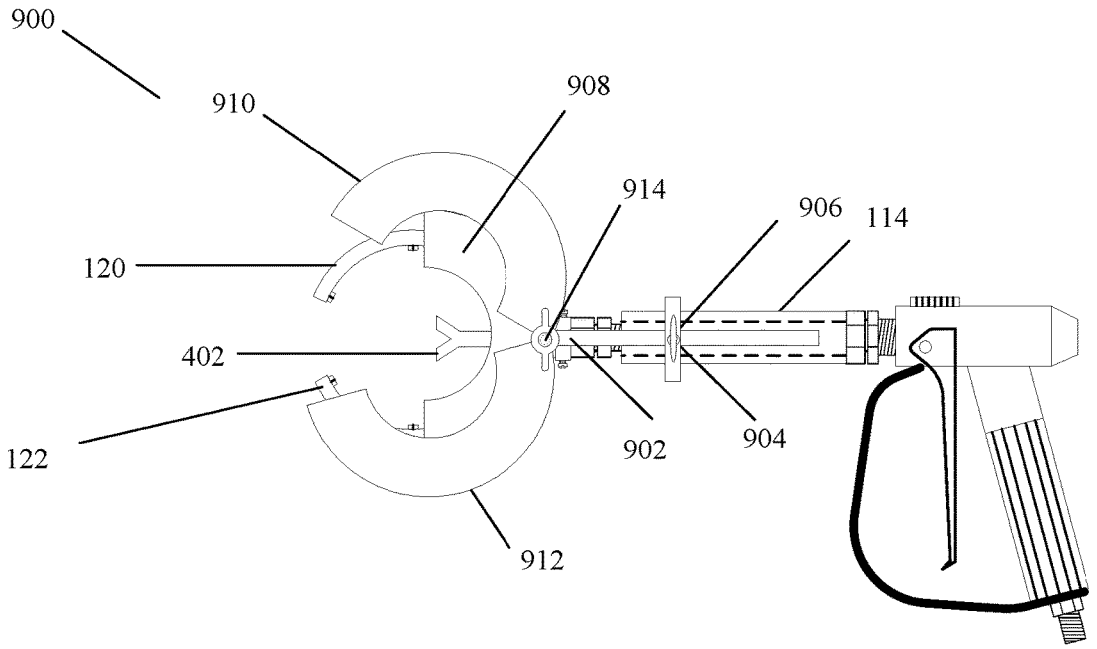
FIG. 9 is a view of the tube spray gun with an open windshield.

FIG. 9 is a view of one embodiment of the tube spray gun with a windshield attached and the windshield being in the open position. The windshield 900 may comprise a windshield positioner 902, an extension holder 904, and extension retention adjustment 906, a center windshield 908, an upper windshield 910, and a lower windshield 912, and a windshield position adjustment 914. This windshield 900 may be used when coating a tubular member and the wind conditions are less than desirable. The upper wind shield 910 and the lower windshield 912 may be constructed of thin material that is capable of resisting the wind without deforming. They are moved to the open position by the user, the spray gun may be placed in the desired position using the positioner 402 or the roller positioner 500 around the tube wherein the positioner engages the tubular member. Then the upper windshield 910 and lower windshield 912 are placed around the member to be coated without touching the surface and the windshield position adjustment 914 may be tightened to hold the upper and lower windshields 910, 912 in the desired position. See FIG. 10. The windshield position adjustment 914 may be a wing nut that is easily adjusted to allow for a quick positioning of the spray gun and windshield, but one skilled in the art may use other devices or methods known to perform this function. After the engagement of the spray gun and positioner, the lower spray tip assembly 122 is placed in the operating position and the user may coat the surface of the tubular member while the wind shield protects the spray nozzles 124 from the wind and minimizes the material loss.

The windshield positioner 902 may be moved laterally to a desired position. The windshield positioner 902 slides through the extension holder 904 wherein the position may be fixed upon the tightening of the extension retention adjustment 906 which may be preferably a thumb screw. However, one skilled in the art would be aware of other methods of securing the windshield positioner 902 in place. Additionally, the extension holder 904 may be combined with the positioner holder 404 to create a single piece that allows the use of both the positioner holder 404 and windshield positioner 902 simultaneously.

Figure 10:
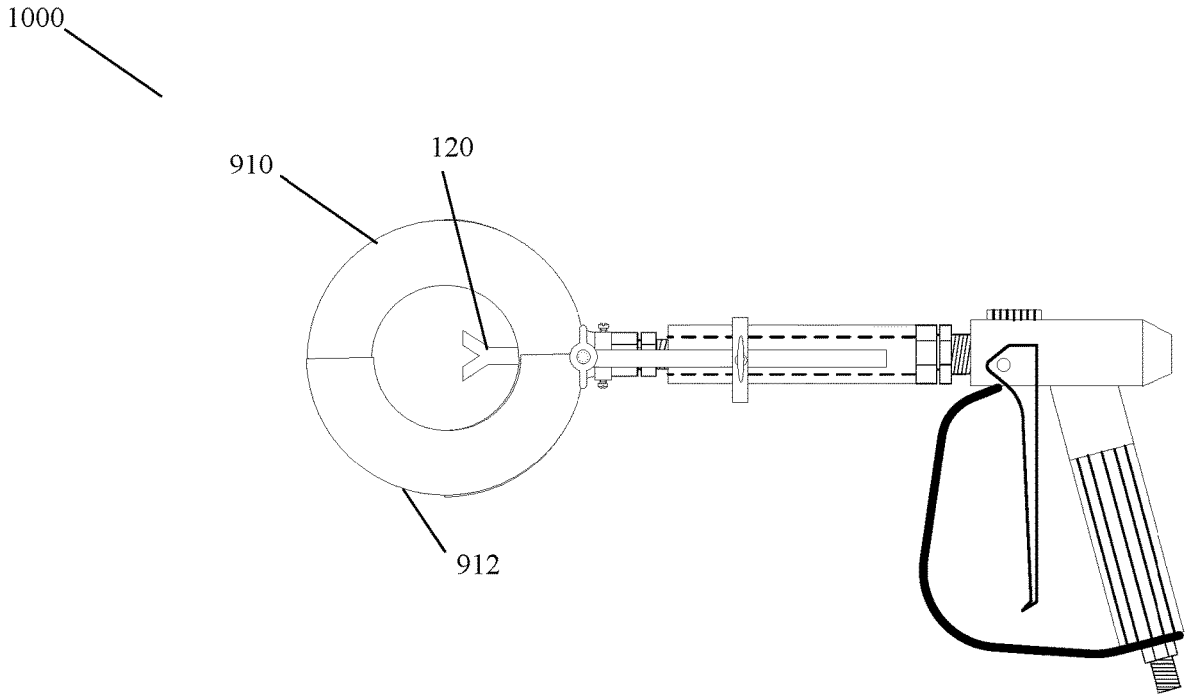
FIG. 10 is a view of the tube spray gun with a closed windshield.

FIG. 10 a view of the tube spray gun with the windshield in the closed position 1000. In the closed position, the upper windshield 910 and the lower windshield 912 covers and protects the spray nozzle assemblies 120, 122 thus preventing overspray and also preventing high winds from affecting the coating of the member. Excess paint that collects on the windshield may flow downward to the bottom of windshields 908,912 wherein it may flow into a coating recovery tray 1100 described below in FIG. 11. Once a tubular member has been coated then the user unscrews the windshield position adjustment 914 allowing the upper windshield 910 and the lower windshield 912 to open and the user to disengage the spray gun from the tubular member.

Figure 11:
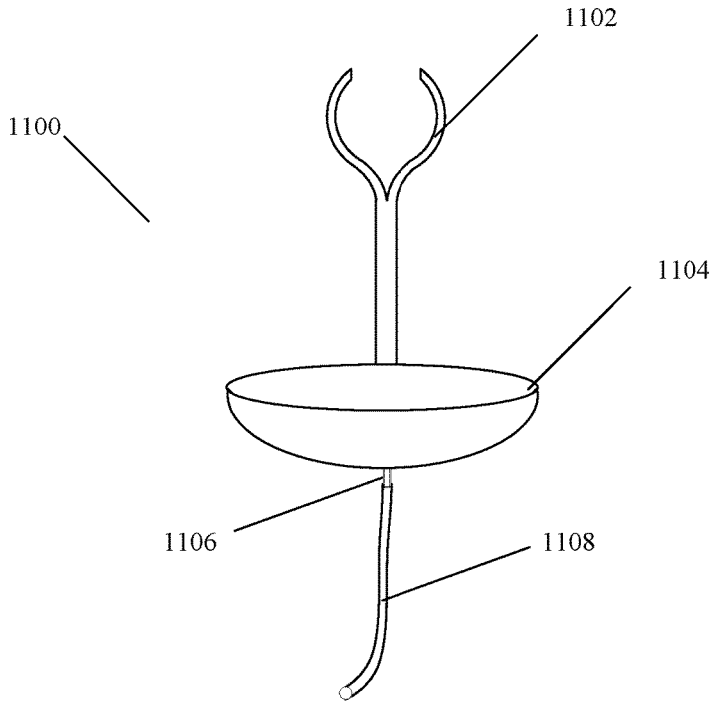
FIG. 11 is a view of a coating recover tray.

FIG. 11 is a view of a preferred embodiment of coating recovery tray 1100. The coating tray 1100 may comprise an attachment point 1102, the coating tray 1104, drain 1106 and a coating return tube 1108. The coating tray 1100 allows the recovery of overspray and excess coating. This embodiment with the attachment point 1102 being fixed may use pressure to maintain the coating tray 1100 in the desired position.

Figure 12:
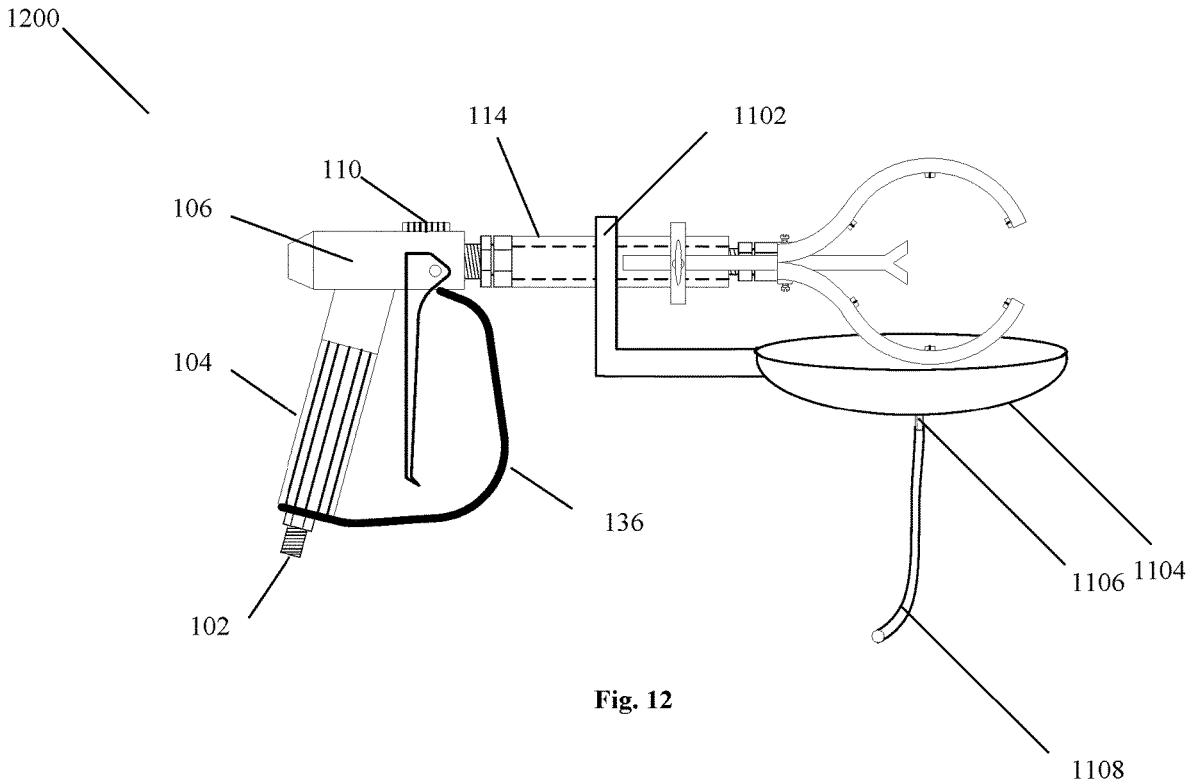
FIG. 12 is a view of the tube spray gun with a coating recovery tray.

FIG. 12 shows the coating tray 1100 fixedly attached to an embodiment of the spray gun 600 in the desired position to capture any excess coating 1200. The coating tray 1100 is fixedly attached to the extension 114 through friction and pressure. One skilled in the art may use other methods known to securely attach the coating tray 1100 to the spray gun 600. The user opens the attachment point 1102 until it capable of accepting the extension 114 of a spray gun 600. Once opened, the extension 114 is moved into a position to engage the attachment point 1102 wherein the attachment point 1102 is released to secure the extension 114. The coating tray 1100 may remain in a fixed position even though the spray tip assemblies may be rotated. However, the coating tray 1100 may be rotated to a desired position by the user by holding the extension 114 in the desired position and then rotating the coating tray 1100 by disengaging the attachment point 1102 until the coating tray 1100 reaches a desired position. The coating tray 1100 may capture any excess coating that drips from the spray assemblies, the positioners, the tubular member and the wind shield.

Having thus described the invention, I claim:

1. An apparatus for coating an elongated member comprising:

a. a handle;

b. a flow trigger;

c. at least one positioner for engaging the elongated member and to maintain a spray tip assembly in a desired position relative to the elongated member;

d. a mounting means for releasably engaging the spray tip assembly around the elongated member and said mounting means including an opener having a release which, when activated biases the apparatus into an open position, the force for biasing from a group consisting a spring, rubber band, hydraulic force, and pneumatic force;

e. a coating supply fluidly connected to the spray tip assembly and a flow a ctivated by the trigger;

f. the spray tip assembly calibrated to provide complete radial coverage for coating the elongated member, whereby a user engages the positioner for placing the apparatus around the elongated member and activates the flow trigger while moving the apparatus for coating an entire radial surface of the elongated member with a single pass, g. the handle is configured to be rotated with respect to the spray tip assembly; and h. the opener comprises a linkage attached to the spray tip assembly.

2. The apparatus of claim 1, where the positioner is a roller.

3. The apparatus of claim 1, where the positioner is adjustable.

4. The apparatus of claim 1, where the mounting means includes a closer having a latch which, when activated biases the apparatus into a closed position, the force for biasing from a group consisting a spring, rubber band, hydraulic, and pneumatic.

5. The apparatus of claim 1, where a recapture tray collects and retains excess coating from overspray and drips whereby some can be recycled.

6. The apparatus of claim 1, where a coating volume flow rate control provides a desired amount of coating for coating the elongated members while reducing overspray and dripping.

7. The apparatus of claim 1, where the spray tip assembly may be adjusted to ensure a coating volume flow rate remains constant.

8. The apparatus of claim 1, where the spray tip assembly does not fully enclose the elongated member and provides complete radial coverage.

9. The apparatus of claim 1, where the spray tip assembly may be rotated.

10. The apparatus of claim 1, where the spray tip assembly consist of a plurality of spray nozzles.

11. The apparatus of claim 1, where the spray tip assembly consists of a plurality of spray nozzles, where the spray nozzles may be adjustable to a wide or narrow spray pattern.

12. The apparatus of claim 1, where the spray tip assembly consists of a plurality of spray nozzles, where the spray nozzles may be calibrated individually to provide even flow rates around an entire circumference of the spray tip assembly.

13. The apparatus of claim 1, the spray tip assembly consists of a plurality of spray nozzles, where the spray nozzles may be calibrated in groups to provide even flow rates around an entire circumference of the spray tip assembly.

14. The apparatus of claim 1, where the spray tip assembly setting may be selected from a focused spray pattern for spraying in windy conditions and a dispersed pattern for calm conditions for better coverage.

15. The apparatus of claim 1, where the spray tip assembly has a windshield attached to enable use in high wind conditions.

16. The apparatus of claim 15, where the windshield is adjustable.

17. An apparatus for coating an elongated member comprising:

a. a handle;
b. a flow trigger;
c. a positioner for engaging the elongated member and to maintain a spray tip assembly in a desired position relative to the elongated member;
d. a spray tip assembly having,
  i. an inlet fluidly connected to the flow trigger, and
  ii. a plurality of spray nozzles inwardly spraying and radially positioned to provide full coverage for spraying the elongated member;
e. a closed mounting having,
  i. a spring biasing the mounting in a closed position, and
  ii. an opening lever forcing the mounting open for releasably engaging the spray tip assembly around the elongated member; and
f. a coating supply, whereby a user opens the mounting, places the apparatus a round the elongated member and engagesthe positioner, releases the mounting and activatesthe flow trigger while moving the apparatus along the elongated member for coating an entire radial surface of the elongated member with a single pass; and
g. the handle is configured to be rotated with respect to the spray tip assembly.

18. An apparatus for coating an elongated member comprising:

a. a handle
b. a flow trigger
c. a positioner for engaging the elongated member and to maintain a spray tip assembly in a desired position relative to the elongated member;
d. an open mounting having;
  i. a spring biasing the mounting in an opened position
  ii. a closing lever forcing the mounting closed for releasably engaging the spray tip assembly around the elongated member;
  iii. a latch for maintaining the mounting in a closed position
e. a coating supply
f. a spray tip assembly having;
  i. an inlet fluidly connected to a flow trigger
  ii. a plurality of spray nozzles inwardly spraying and radially positioned to provide full coverage for spraying the elongated member, whereby a user places the apparatus around the elongated member, engages the positioner and closes and locks the mounting in the operational position and activates the flow trigger while moving the apparatus along the elongated member for coating an entire radial surface of the elongated member with a single pass;
g. the handle is configured to be rotated with respect to the spray tip assembly.

19. An apparatus for coating an elongated member comprising:

a. a handle
b. a flow trigger
b. a roller for engaging the elongated member and to maintain a spray tip assembly in a desired position relative to the elongated member;
d. a fixed mounting having an opening for releasably engaging the spray tip assembly around the elongated member;
e. a coating supply
f. a spray tip assembly having,
  i. an inlet fluidly connected to a flow trigger
  ii. a plurality of spray nozzles inwardly spraying and radially positioned to provide full coverage for spraying the elongated member, whereby a user engages the positioner placing the apparatus a round the elongated member and activates the flow trigger while moving the apparatus along the elongated member for coating an entire radial surface of the elongated member with a single pass;
g. the handle is configured to be rotated with respect to the spray tip assembly; and
h. a mounting means for releasably engaging the spray tip assembly around the elongated member and includes an opener having a release which, when activated biases the apparatus into an open position, the force for biasing from a group consisting a spring, rubber band, hydraulic force, and pneumatic force;
  i. the opener comprises a linkage attached to the spray tip assembly.

* * * * *